US009235196B2

(12) United States Patent
Watanabe et al.

(10) Patent No.: US 9,235,196 B2
(45) Date of Patent: Jan. 12, 2016

(54) CONSTANT VOLTAGE CIRCUIT AND ANALOG ELECTRONIC CLOCK

(71) Applicant: Seiko Instruments Inc., Chiba-shi, Chiba (JP)

(72) Inventors: Kotaro Watanabe, Chiba (JP); Makoto Mitani, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 32 days.

(21) Appl. No.: 14/161,235

(22) Filed: Jan. 22, 2014

(65) Prior Publication Data

US 2014/0204720 A1 Jul. 24, 2014

(30) Foreign Application Priority Data

Jan. 23, 2013 (JP) ..... 2013-010533

(51) Int. Cl.
*G04G 19/02* (2006.01)
*G04G 19/06* (2006.01)
*G04C 10/00* (2006.01)

(52) U.S. Cl.
CPC ..... *G04G 19/06* (2013.01); *G04C 10/00* (2013.01); *G04G 19/02* (2013.01)

(58) Field of Classification Search
CPC ..... G04C 10/00; G04C 3/008; G04G 19/02; G04G 19/06
USPC ..... 368/204
See application file for complete search history.

(56) References Cited

U.S. PATENT DOCUMENTS 4,358,728 A * 11/1982 Hashimoto ..... G04G 19/06 323/275
4,377,740 A * 3/1983 Uga ..... 377/2
4,430,008 A * 2/1984 Nishikubo ..... G04C 3/14 368/202
5,155,467 A * 10/1992 Matsubara ..... 340/429
6,693,851 B1 * 2/2004 Fujisawa et al. ..... 368/203
2014/0217950 A1 * 8/2014 Watanabe et al. ..... 318/503

FOREIGN PATENT DOCUMENTS

JP 2000-298523 A 10/2000
JP 2008-192083 A 8/2008

OTHER PUBLICATIONS

Partial translation of JP 2000-298523 :: Source—platpat.inpit.go.jp ; Apr. 17, 2015.*

* cited by examiner

*Primary Examiner* — Sean Kayes
(74) *Attorney, Agent, or Firm* — Brinks Gilson & Lione

(57) ABSTRACT

There are provided a constant voltage circuit that features low current consumption and stable operation, and an analog electronic clock provided with the constant voltage circuit. The constant voltage circuit includes a differential amplifier circuit which is turned on/off by a predetermined signal and which controls the voltage of a gate of an output transistor on the basis of a reference voltage and a feedback voltage that are received, a switch circuit which is connected to an output terminal of the differential amplifier circuit and which is turned on/off by a predetermined signal, and a voltage holding circuit which is connected between the gate of the output transistor and a power supply terminal and which has a resistor and a capacitor connected in series. An analog electronic clock provided with the foregoing constant voltage circuit that supplies a voltage to at least an oscillation circuit and a frequency division circuit.

2 Claims, 4 Drawing Sheets

CONSTANT VOLTAGE CIRCUIT AND ANALOG ELECTRONIC CLOCK

RELATED APPLICATIONS

This application claims priority under 35 U.S.C. §119 to Japanese Patent Application No. 2013-010533 filed on Jan. 23, 2013, the entire content of which is hereby incorporated by reference.

BACKGROUND OF THE INVENTION

1. Field of the Invention

The present invention relates to a constant voltage circuit featuring reduced power consumption and to an analog electronic clock.

2. Background Art

FIG. 3 is a block diagram of an analog electronic clock. The analog electronic clock includes a semiconductor device 1, a crystal 2, a battery 3, and a motor 4. The semiconductor device 1 includes an oscillation circuit 11, to which the crystal 2 is connected, a frequency division circuit 12, a constant voltage circuit 10, which outputs a constant voltage Vreg for driving the oscillation circuit 11 and the frequency division circuit 12, and an output circuit 13 which drives the motor 4.

An analog electronic clock is required to minimize the frequency of replacing the battery thereof, so that the semiconductor device 1 is required to reduce current consumption. As a method for reducing the current consumption, the constant voltage circuit 10 that consumes less current has been proposed (refer to Patent Document 1).

FIG. 4 is a block diagram of a conventional constant voltage circuit. The conventional constant voltage circuit 10 includes a reference voltage circuit 101 that generates a reference voltage Vref, a differential amplifier circuit 102, an output transistor 103, a voltage dividing circuit 104, a holding circuit 105 composed of a capacitor, and a switch circuit 106.

The conventional constant voltage circuit 10 has the holding circuit 105 that holds the gate voltage of the output transistor 103, and reduces power consumption by intermittently operating the differential amplifier circuit 102 and the like. The operation of the differential amplifier circuit 102 is interrupted by a signal Φ1 and the switch circuit 106 is turned off. At this time, the gate voltage of the output transistor 103 is held by the holding circuit 105 at a voltage before the switch circuit 106 was turned off. Unless a load current significantly varies, the constant voltage circuit 10 is capable of outputting the constant voltage Vreg.

[Patent Document 1] Japanese Patent Application Laid-Open No. 2000-298523

However, the conventional constant voltage circuit 10 is incapable of maintaining an output voltage in the case where a load current significantly varies. More specifically, if a battery voltage suddenly falls while the switch circuit 106 is off, then the gate-source voltage of the output transistor 103 decreases, undesirably causing the constant voltage Vreg to vary. Further, if the constant voltage Vreg falls below an oscillation stop voltage VDOS of the oscillation circuit 11, then the oscillation circuit 11 may lose stability and stop oscillation.

SUMMARY OF THE INVENTION

The present invention has been made with a view toward solving the problems described above and provides a constant voltage circuit capable of providing a stable constant voltage even if a battery voltage varies while a motor is running.

A constant voltage circuit in accordance with the present invention includes: an output transistor connected between an output terminal and a power supply terminal; a voltage dividing circuit, which is connected between the output terminal and a grounding terminal and which divides an output voltage of the output terminal and outputs a feedback voltage; a reference voltage circuit which outputs a reference voltage; a differential amplifier circuit, which is turned on/off by a predetermined signal and which controls a voltage of a gate of the output transistor on the basis of a reference voltage and a feedback voltage that are received; a switch circuit, which is connected to an output terminal of the differential amplifier circuit and which is turned on/off by a predetermined signal; and a voltage holding circuit, which is connected between the gate of the output transistor and the power supply terminal and which has a resistor and a capacitor connected in series.

An analog electronic clock in accordance with the present invention includes: an oscillation circuit, which outputs a clock signal of a fixed frequency; a frequency division circuit, which divides the frequency of the clock signal output from the oscillation circuit and outputs a signal of a required frequency; an output circuit, which drives a motor according to a signal output from the frequency division circuit; and the foregoing constant voltage circuit which supplies a voltage to at least the oscillation circuit and the frequency division circuit.

The present invention makes it possible to provide a constant voltage circuit that features low current consumption and a stable operation. This in turn makes it possible to provide an analog electronic clock having a prolonged battery service life.

DETAILED DESCRIPTION OF THE PREFERRED EMBODIMENTS

The following will describe embodiments of the present invention with reference to the accompanying drawings.

Figure 3:
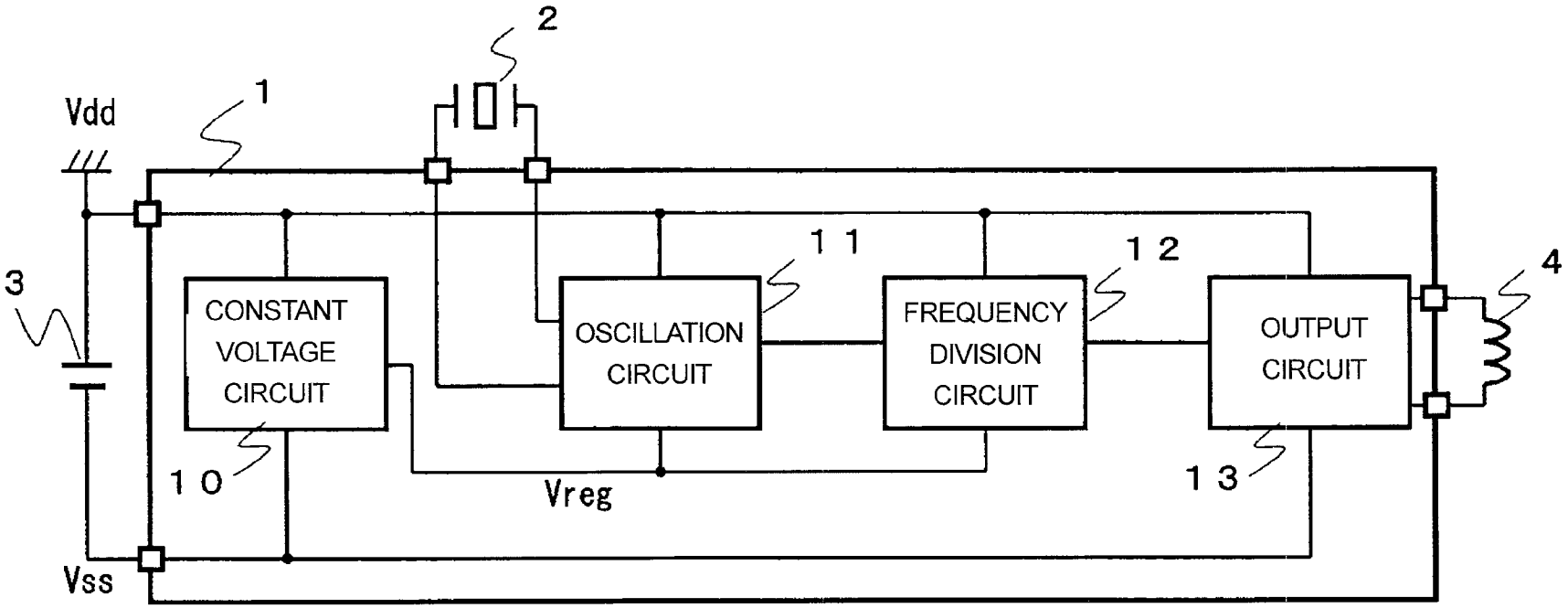
FIG. 3 is a block diagram of an analog electronic clock.
Figure 4:
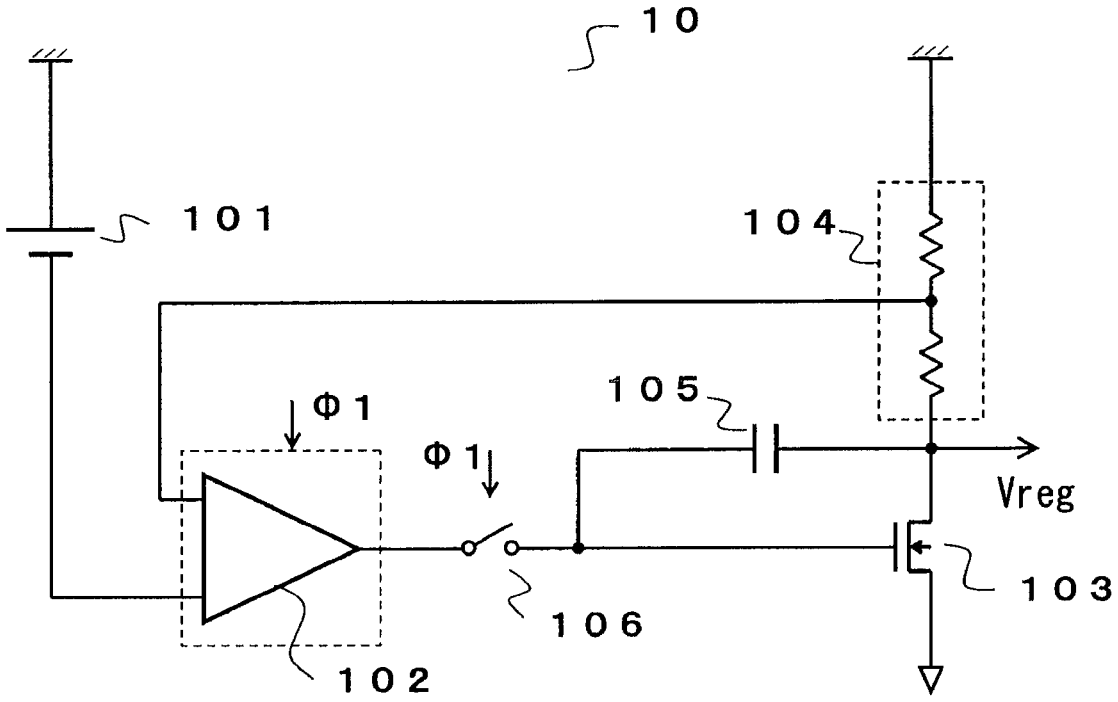
FIG. 4 PRIOR ART
FIG. 4 is a block diagram of a conventional constant voltage circuit.

FIG. 3 is the block diagram of an analog electronic clock. The analog electronic clock is comprised of a semiconductor device 1, a crystal 2, a battery 3, and a motor 4. The semiconductor device 1 is comprised of an oscillation circuit 11 to which the crystal 2 is connected, a frequency division circuit 12, a constant voltage circuit 10 that outputs a constant voltage Vreg for driving the oscillation circuit 11 and the frequency division circuit 12, and an output circuit 13 which drives the motor 4.

The analog electronic clock operates on the basis of a power supply voltage Vdd. In the following description, therefore, all circuits will be based on the power supply voltage Vdd.

The oscillation circuit 11 oscillates the crystal 2, which is external, at a stable frequency and outputs a clock signal of a fixed frequency. The frequency division circuit 12 divides the frequency of the clock signal of the oscillation circuit 11 and issues a signal of a required frequency. The output circuit 13 drives the motor 4 according to the signal of the frequency division circuit 12.

Figure 1:
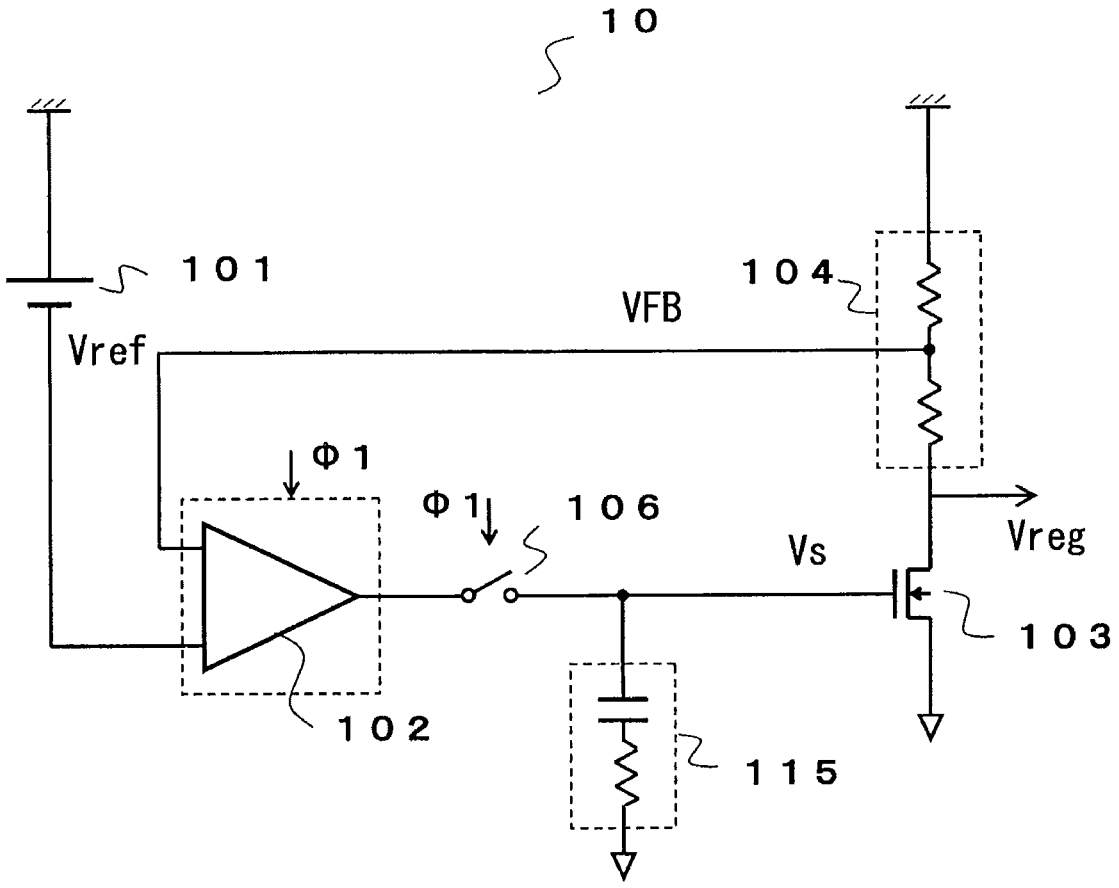
FIG. 1 is a block diagram of a constant voltage circuit according to an embodiment.

FIG. 1 is a block diagram of the constant voltage circuit according to the present embodiment. The constant voltage circuit 10 has a reference voltage circuit 101, a differential amplifier circuit 102, an output transistor 103, a voltage dividing circuit 104, a holding circuit 115, and a switch circuit 106.

The reference voltage circuit 101 generates a reference voltage Vref. The voltage dividing circuit 104 divides the voltage Vreg of the output terminal and outputs a feedback voltage VFB. The differential amplifier circuit 102 outputs a voltage Vs to the gate of the output transistor 103 such that the reference voltage Vref and the feedback voltage VFB become equal. Further, the differential amplifier circuit 102 is controlled to be turned on/off by a signal Φ1. The switch circuit 106 synchronizes with the differential amplifier circuit 102 and is controlled to be turned on/off by the signal Φ1. The holding circuit 115 is composed of, for example, a resistor and a capacitor connected in series, and connected between the gate of the output transistor 103 and a power supply terminal (Vss). When the switch circuit 106 turns off, the holding circuit 115 retains the voltage Vs before the switch circuit 106 was turned off.

The constant voltage circuit 10 implements a reduction in current consumption by the signal Φ1, which controls the turning on/off of the differential amplifier circuit 102.

The operation of the constant voltage circuit 10 according to the present embodiment will now be described.

When the switch circuit 106 is on, the constant voltage circuit 10 operates as a normal voltage regulator. The holding circuit 115 functions as a phase compensation circuit such that the constant voltage circuit 10 carries out a stable operation.

When the switch circuit 106 is off, the holding circuit 115 retains the voltage Vs before the switch circuit 106 was turned off. Further, the output transistor 103 has its gate controlled by the voltage Vs and outputs the constant voltage Vreg.

At this time, if, for example, driving the motor 4 causes a power supply voltage Vss to shift to the Vdd side, then the constant voltage circuit 10 carries out the operation described below.

If the power supply voltage Vss changes to the Vdd side, then the gate voltage Vs of the output transistor 103 is influenced through the holding circuit 115 and changes to the Vdd side. In the output transistor 103, therefore, the voltage between the gate and the source is maintained constant, so that the drain current remains constant. This enables the constant voltage circuit 10 to output the fixed constant voltage Vreg without being affected by a fluctuation in the power supply.

As described above, the constant voltage circuit 10 is capable of reducing current consumption and also carrying out a stable operation due to the holding circuit 115 included therein.

Figure 2:
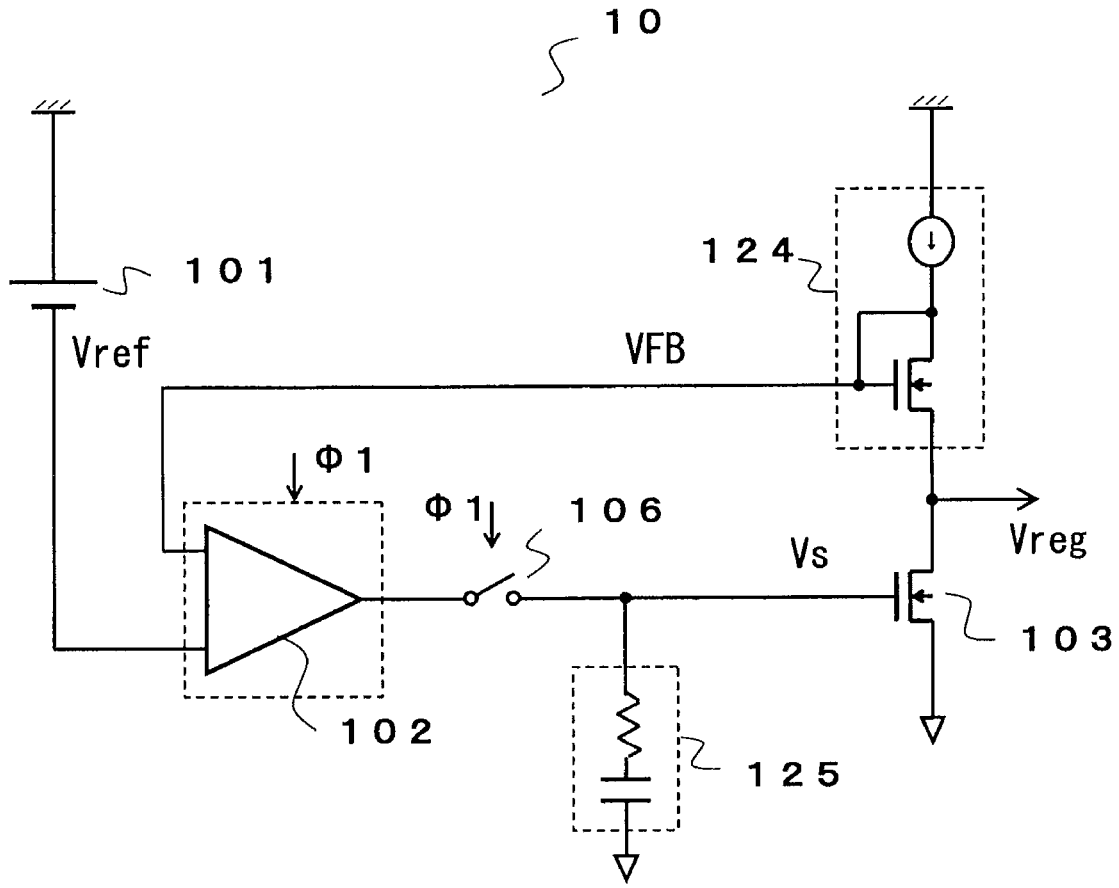
FIG. 2 is a block diagram illustrating another example of the constant voltage circuit according to the embodiment.

FIG. 2 is a block diagram illustrating another example of the constant voltage circuit according to the present embodiment.

As illustrated in FIG. 2, the holding circuit may be configured like a holding circuit 125, and the voltage dividing circuit may be configured like a voltage dividing circuit 124.

The analog electronic clock has been described on the basis of the power supply voltage Vdd. If, however, the analog electronic clock is based on the power supply voltage Vss, then the same advantages can be obtained accordingly.

What is claimed is:

1. A constant voltage circuit comprising:

an output transistor connected between an output terminal and a power supply terminal;

a voltage dividing circuit, which is connected between the output terminal and a grounding terminal and which divides an output voltage of the output terminal and outputs a feedback voltage;

a reference voltage circuit which outputs a reference voltage;

a differential amplifier circuit, which is turned on/off by a predetermined signal and which controls the voltage of a gate of the output transistor on the basis of the reference voltage and the feedback voltage that are received;

a switch circuit, which is connected to an output terminal of the differential amplifier circuit and which is turned on/off by the predetermined signal; and a voltage holding circuit, which is connected between the gate of the output transistor and the power supply terminal and which has a resistor and a capacitor connected in series, wherein when the switch circuit is switched on, the voltage holding circuit is configured to hold a variable voltage output from the differential amplifier circuit to thereby control a voltage of the gate of the output transistor.

2. An analog electronic clock comprising:

an oscillation circuit which outputs a clock signal of a fixed frequency;

a frequency division circuit which divides the frequency of a clock signal output from the oscillation circuit and outputs a signal of a required frequency;

an output circuit which drives a motor according to a signal output from the frequency division circuit; and the constant voltage circuit according to claim 1, which supplies a voltage to at least the oscillation circuit and the frequency division circuit.

* * * * *